United States Patent [19]

Wallis

[11] Patent Number: 5,014,422

[45] Date of Patent: May 14, 1991

[54] METHOD AND APPARATUS FOR FORMING CORE ASSEMBLIES

[76] Inventor: Bernard J. Wallis, 2215 Dacosta, Dearborn, Mich. 48128

[21] Appl. No.: 547,464

[22] Filed: Jul. 2, 1990

[51] Int. Cl.[5] ..... B21D 53/02

[52] U.S. Cl. ..... 29/890.044; 29/466; 29/512; 29/523; 29/727; 29/890.046

[58] Field of Search ..... 29/890.049, 890.043, 29/890.044, 890.045, 890.046, 464, 466, 467, 512, 523, 336, 726, 726.5, 727

[56] References Cited

U.S. PATENT DOCUMENTS

| | | | |
|---|---|---|---|
| 4,391,027 | 7/1983 | Fleury | 29/726 |
| 4,597,171 | 7/1986 | Kitayama et al. | 29/890.044 |
| 4,611,375 | 9/1986 | Zapawa | 29/726 |
| 4,631,813 | 12/1986 | Daniels et al. | 29/727 |
| 4,637,133 | 1/1987 | Freeman | 29/890.043 |
| 4,830,259 | 5/1989 | Lewis | 29/726 |

*Primary Examiner*—Howard N. Goldberg
*Assistant Examiner*—I. Cuda
*Attorney, Agent, or Firm*—Barnes, Kisselle, Raisch, Choate, Whittemore & Hulbert

[57] ABSTRACT

A method and apparatus for forming core assemblies comprising supporting a plurality of flattened tubes in horizontally spaced relationship, applying forces to the ends of the tubes to align the tubes, interposing undulating fins between adjacent tubes, providing a stop for holding the ends of the tubes at one end in alignment, retracting the force on the opposite ends of the tubes applying a compacting force to the array tubes and undulating fins transversely of the tubes by applying forces to end plates, applying a force to a header plate to force the opposite ends of the tubes through openings in the header plate, applying a deforming force to the opposite ends of the tubes against the outer surface of the header plate to move any unaligned tubes into alignment with the remainder of the tubes against the stop, retracting the stop, applying a force to another header plate to force the one ends of the tubes through openings in the header plate and applying a deforming force to the one ends of the tubes onto the other header plate.

9 Claims, 11 Drawing Sheets

20
21
22
25
26
27
28
29
37
38
S
T
F
H

METHOD AND APPARATUS FOR FORMING CORE ASSEMBLIES

This invention relates to making core assemblies.

BACKGROUND AND SUMMARY OF THE INVENTION

One type of core assembly which is presently being manufactured comprises a plurality of flattened tubes with undulating fins, top and bottom end plates extending parallel to the tubes and side header plates through which the ends of the tubes extend and are deformed to provide the assembly. Such core assemblies are used in automotive radiators and the like.

One method of manufacture of such core assemblies heretofore has been to provide an array of flattened tubes, interposing the fins between the tubes, simultaneously apply forces to the ends of the tubes to bring the tubes in general alignment, then compacting the tubes transversely, forcing the header plates over the ends of the tubes and deforming the ends of the tubes.

It has been found that such a method functions satisfactorily. However, it is necessary for the tubes to be provided in the array in generally aligned relationship and therefore it is required that the apparatus deliver the tubes to the array in a more precise fashion.

Among the objectives of the present invention are to provide an improved method and apparatus wherein the tubes need not be delivered to that initial array in such precise fashion; wherein the method and apparatus provides for improved efficiency; and wherein substantial labor saving is achieved.

In accordance with the invention, the method and apparatus for forming core assemblies comprises supporting a plurality of flattened tubes in horizontally spaced relationship, applying forces to the ends of the tubes to align the tubes, interposing undulating fins between adjacent tubes, providing a stop for holding the ends of the tubes at one end in alignment, retracting the force on the opposite ends of the tubes applying a compacting force to the array tubes and undulating fins transversely of the tubes by applying forces to end plates, applying a force to a header plate to force the opposite ends of the tubes through openings in the header plate deforming the opposite ends of the tubes against the outer surface of the header plate, retracting the stop, applying a force to another header plate to force the one ends of the tubes through openings in the header plate and applying a deforming force to the one ends of the tubes onto the other header plate move any unaligned tubes into alignment with the remainder of the tubes against the stop.

DESCRIPTION OF THE DRAWINGS

FIGS. 1A, 1B–7A, 7B are diagrams showing the method of assembly.

DESCRIPTION

Figure 1A:
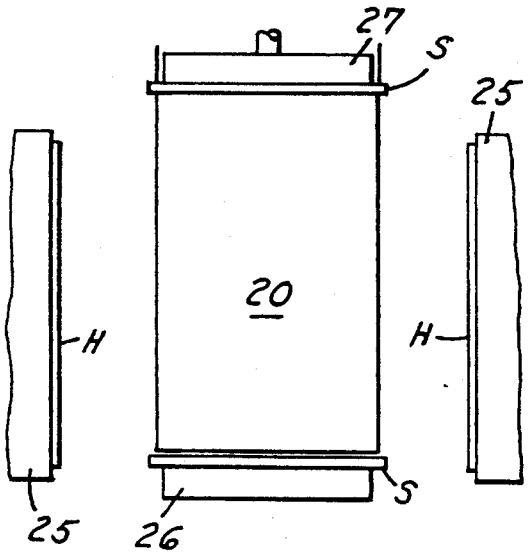

The method embodying the invention comprises the steps of:

supporting a plurality of flattened tubes in horizontally spaced relationship, interposing undulating fins between adjacent tubes, applying forces to the ends of the tubes to align the tubes, providing a stop to hold the ends of the tubes at one end in alignment, retracting the force on the opposite ends of the tubes, applying a compacting force to the array of tubes and undulating fins transversely of the tubes, applying a force to a header plate to force the opposite ends of the tubes through openings in the header plate at one end, deforming the ends of the tubes against the outer surface of the header plate to move any unaligned tubes into alignment with the remainder of the tubes against the stop, retracting the stop, maintaining the force on the first mentioned header plate, applying a force on another header plate to force the one ends of the tubes through openings in the other header plate, applying a force to deform the other ends of the tubes onto the other header plate, and removing the force on the header plates.

The aforementioned steps are preferably performed by an apparatus such as shown schematically in FIGS. 1A, 1B–7A, 7B which comprises a horizontal table 20 onto which the flattened tubes T are delivered, as presently described. Slides 21, 22 support a plurality of pickets 23 which are movable horizontally on the retainers and have fingers 24 which cooperate with the fingers of an adjacent picket 23 to receive and space tubes T and compact the tubes T, as presently described. The apparatus further includes header supports 25 which support header plates H and includes a stop 26 which cooperates with a clamp 27 for compacting the tubes T transversely, as presently described. The apparatus further includes a rotatable backup bar 28 that forms a stop cooperating with a member 29 on slide 21 to backup the slide 21.

Figure 1B:
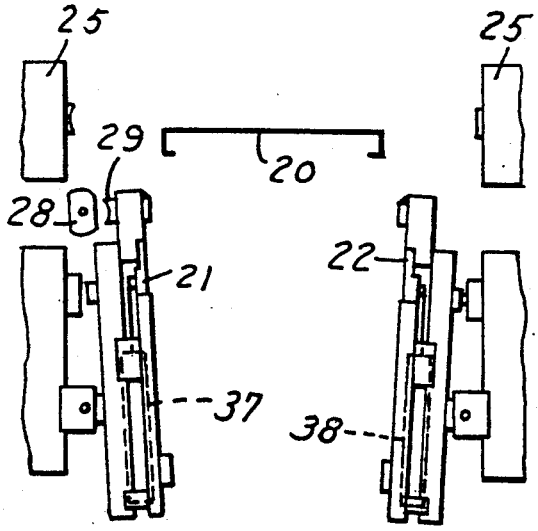

Referring to FIGS. 1A, 1B–7A, 7B, the steps comprise:

Step 1 (FIGS. 1A, 1B)

Figure 2A:
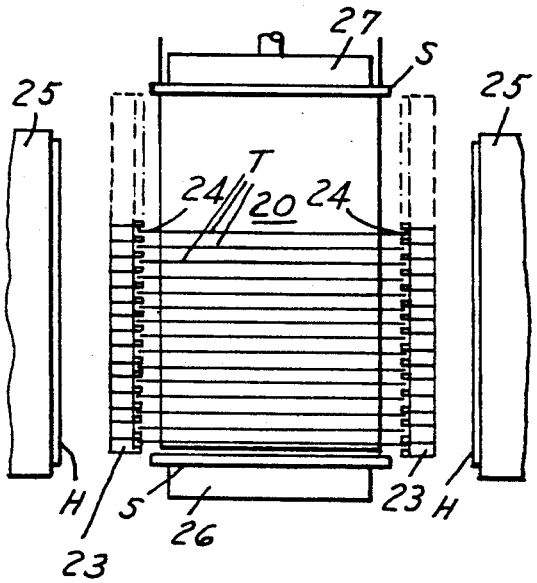
Figure 2B:
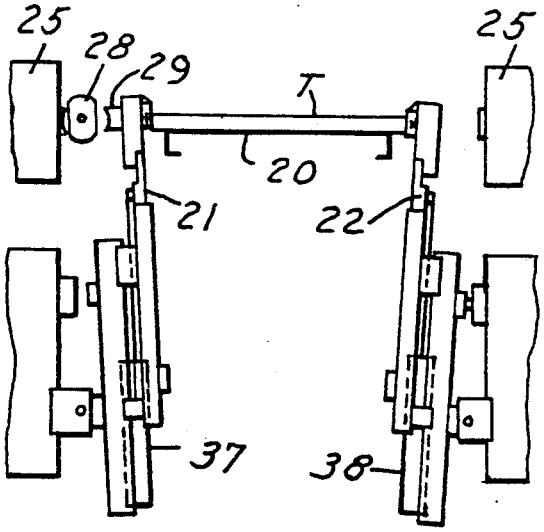

Start condition,
Manually load header plates H,
Slides 21, 22 down,
Manually load side bars S
Slides 21, 22 open, Step 2 (FIGS. 2A, 2B)

Start cycle,
Slides 21, 22 up,
Slides 21, 22 open,

Pickets 23 open

Figure 3A:
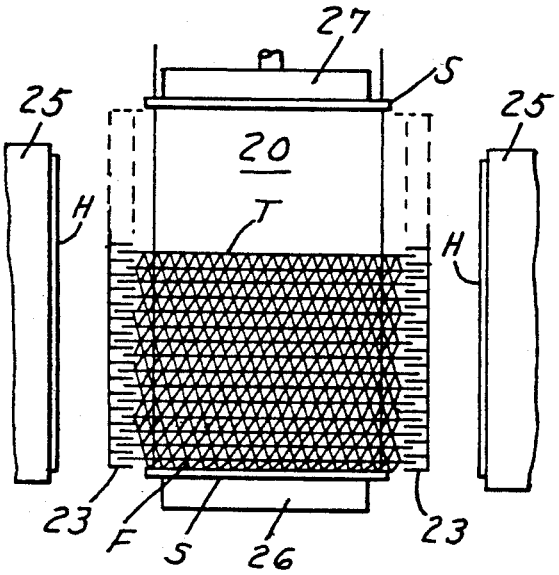
Figure 3B:
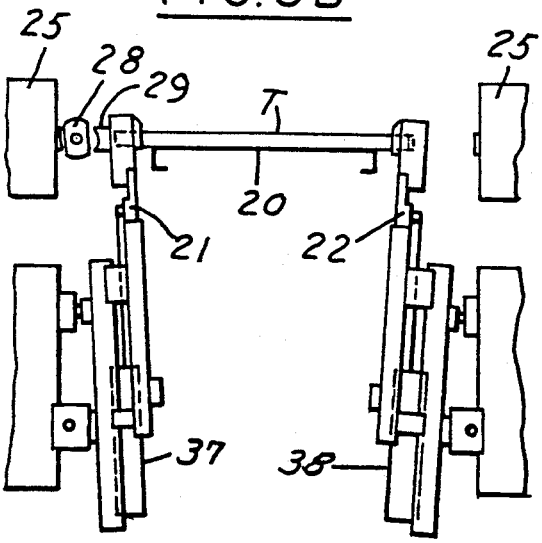

Step 3 (FIGS. 3A, 3B)

Load tubes T by a dispensing mechanism,
Load fins F (manually)

Figure 4A:
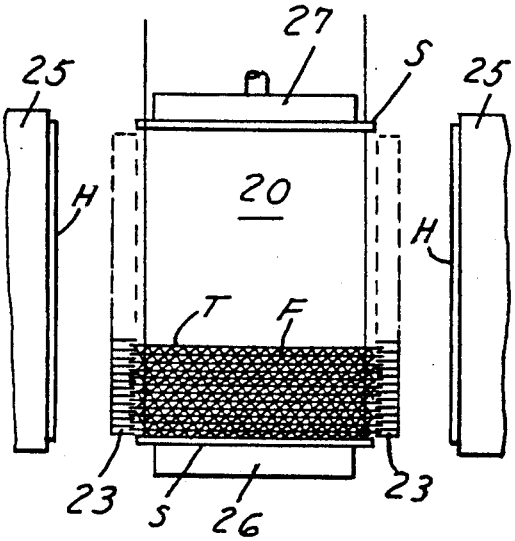
Figure 4B:
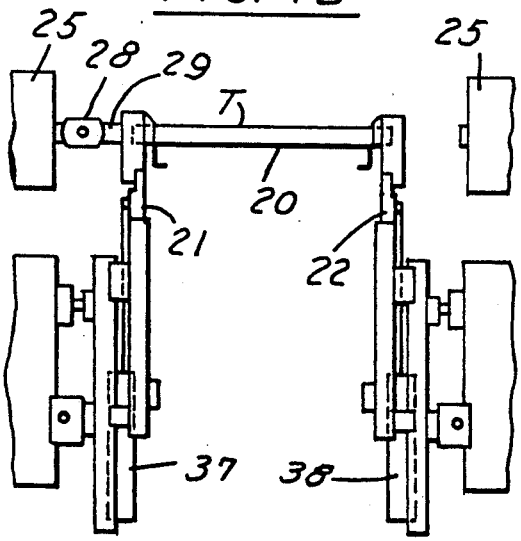

Step 4 (FIGS. 4A, 4B)

Figures 5A, 5B, 6A, 6B, 7A, 7B:
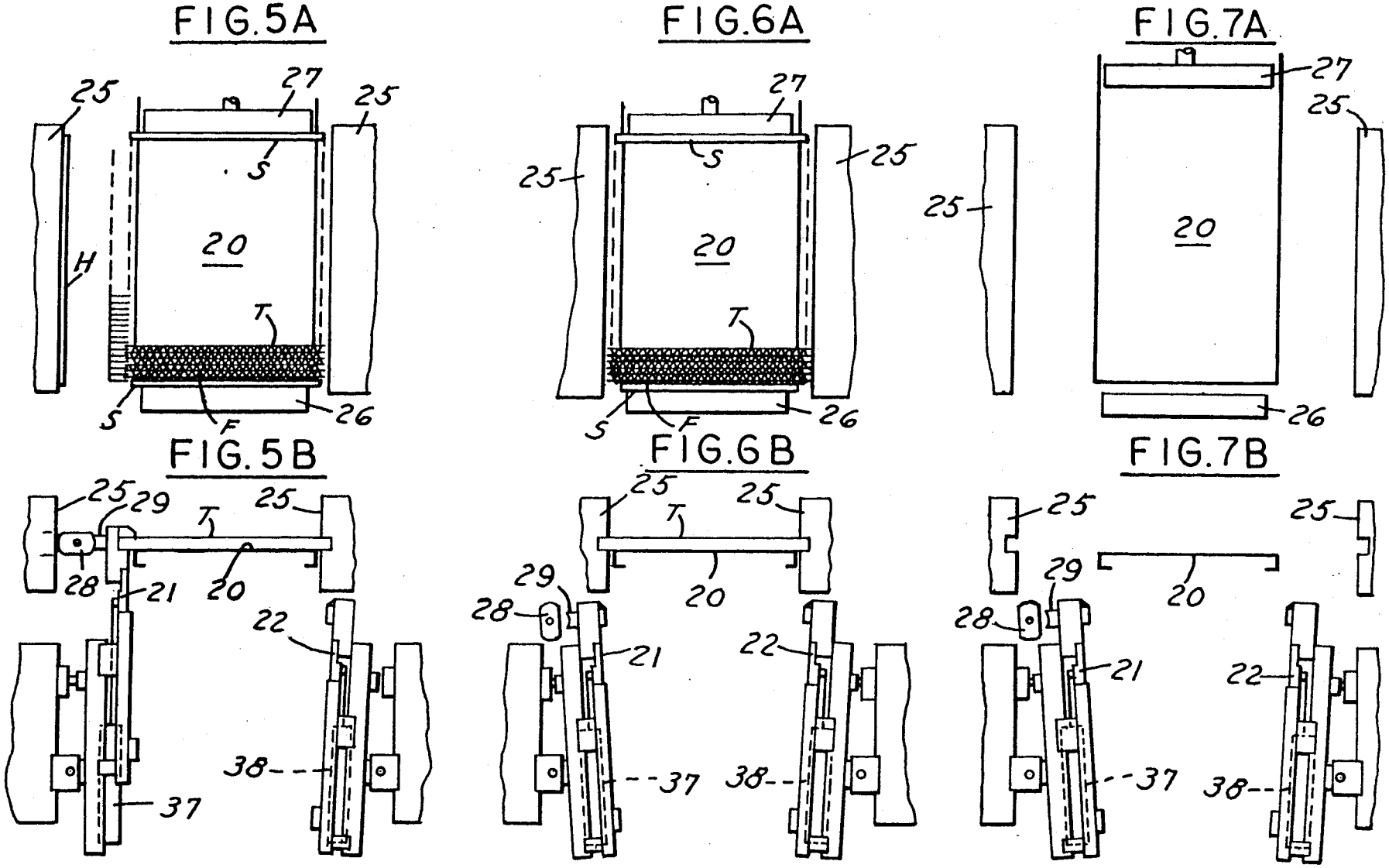

Slides 21, 22 close, equalizing the tube lengths,
Core clamped in by moving plunger 27,
Backup bar 29 is rotated inwardly,
Pickets 24 close Step 5 (FIGS. 5A, 5B)

Right hand slide 22 opens,
Right hand slide 22 moves down,
Right hand header 25 moves in to move the ends of the tubes T through the header H (left hand side) and to stake the ends Step 6 (FIGS. 6A, 6B)

Backup bar 28 is rotated out,
Left hand slide 21 opens,
Left hand slide 21 moves down,
Left hand header slide 25 moves in to move the other ends of the tubes T inwardly and stake the ends Step 7 (FIGS. 7A, 7B)

Core clamp 27 moves out,
Header slides 25 move out,
Pickets 24 open,
Unload core manually.

The apparatus more specifically is shown in FIGS. 8–13 wherein corresponding reference numerals are utilized for clarity.

Figure 8:
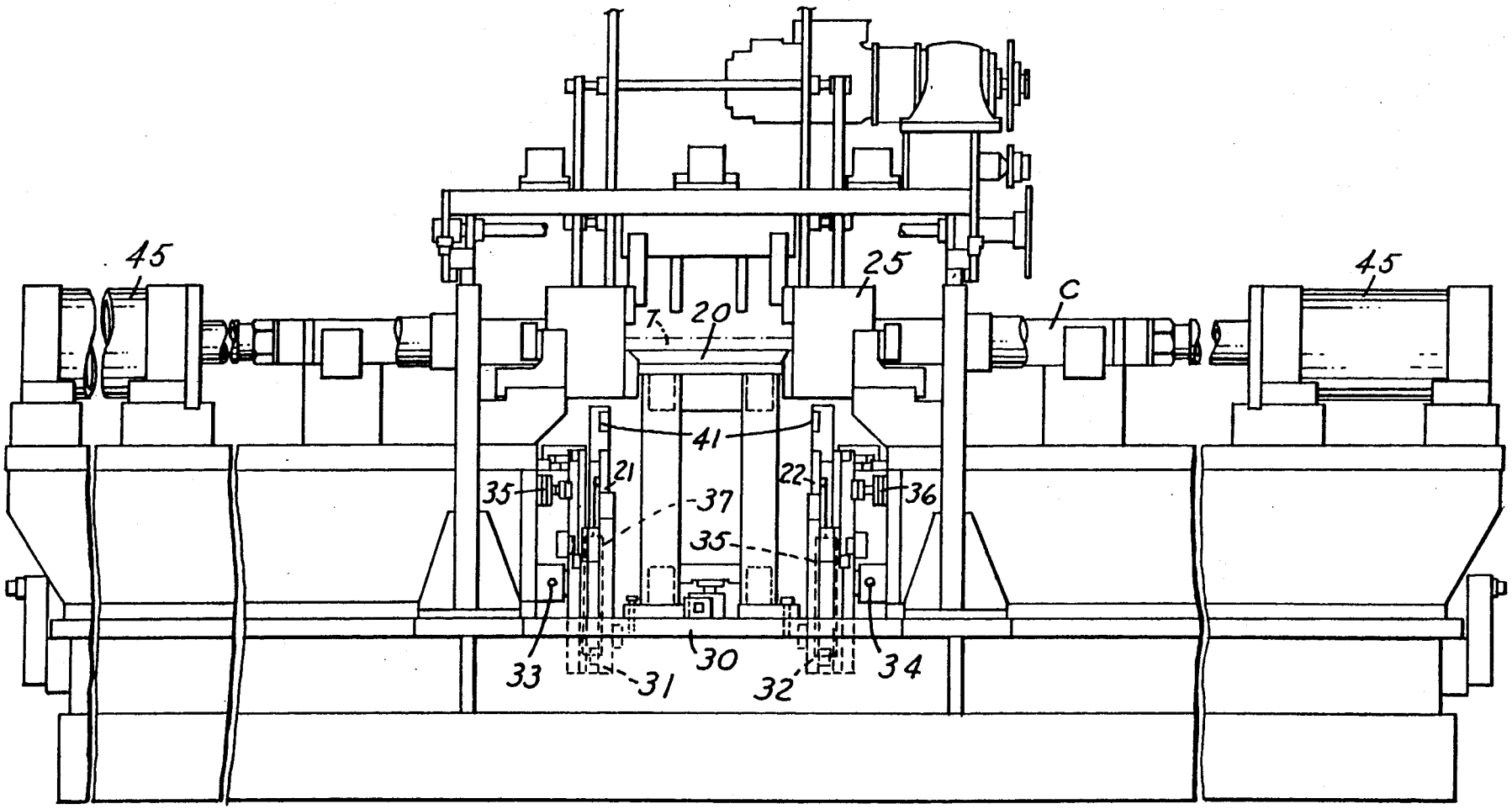
FIG. 8 is a front elevational view of an apparatus for performing the method.
Figure 9:
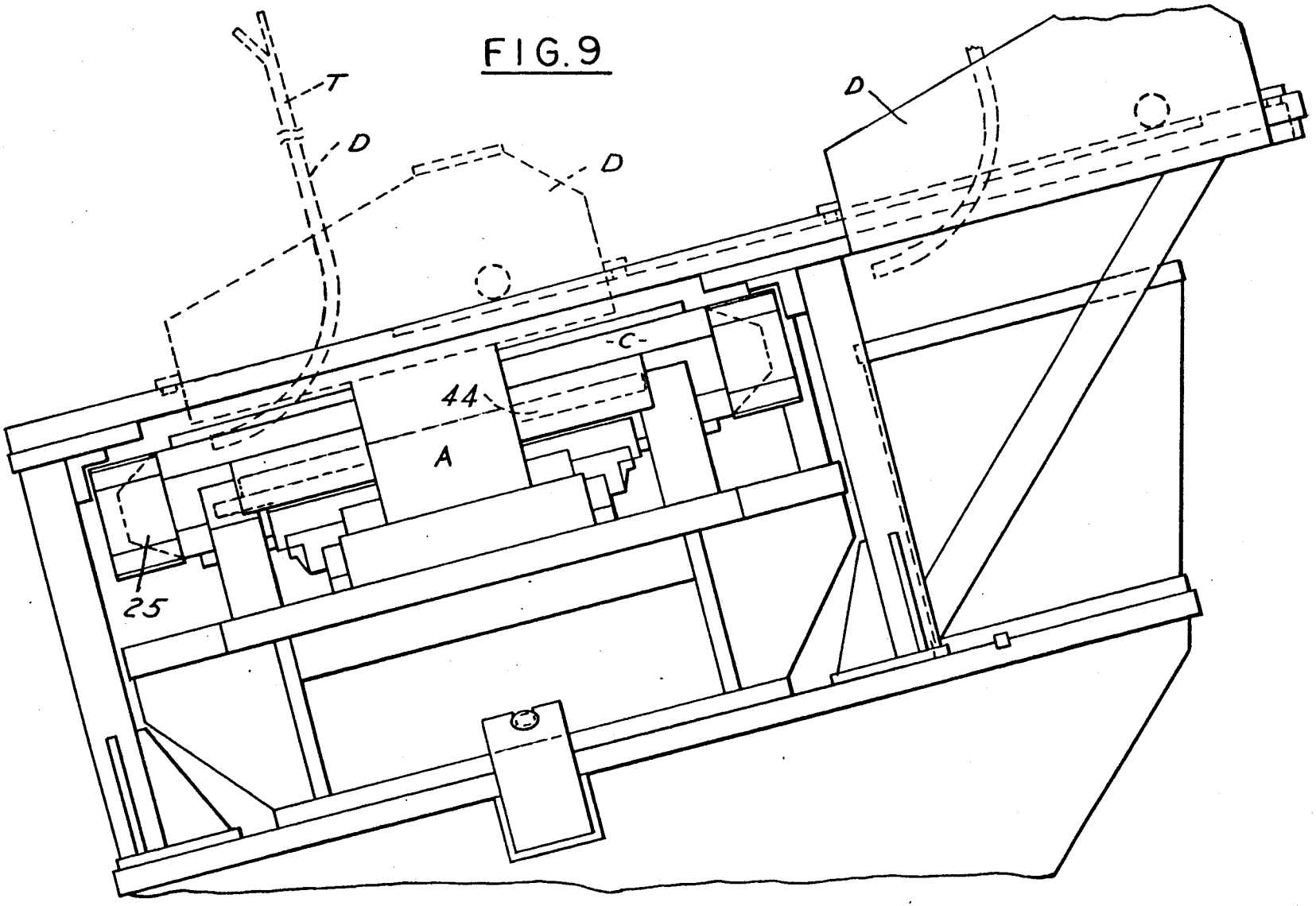
FIG. 9 is a fragmentary side elevational view of the apparatus.
Figure 10:
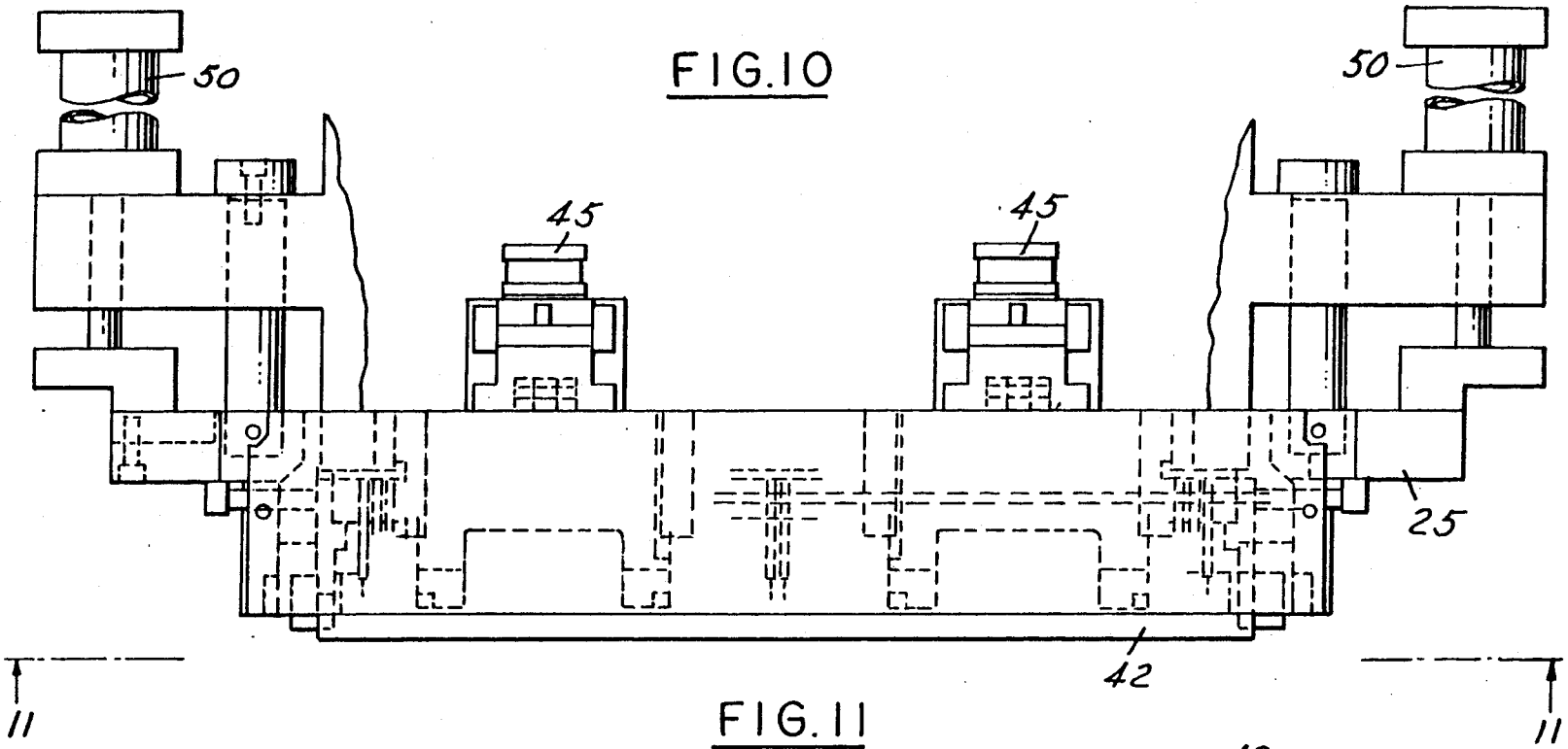
FIG. 10 is a fragmentary plan view of a portion of the apparatus.
Figure 11:
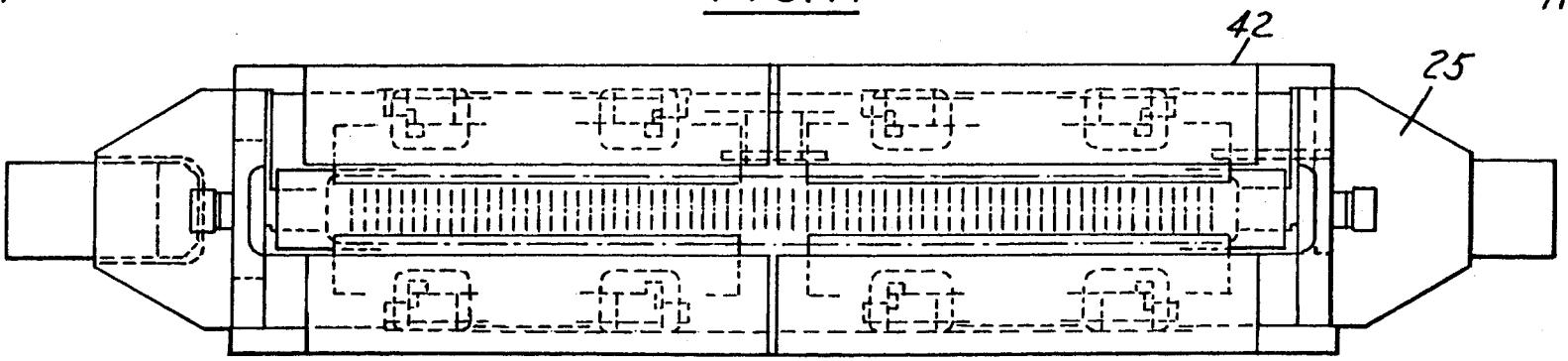
FIG. 11 is a fragmentary sectional view taken along the line 11—11 in FIG. 10.
Figure 12:
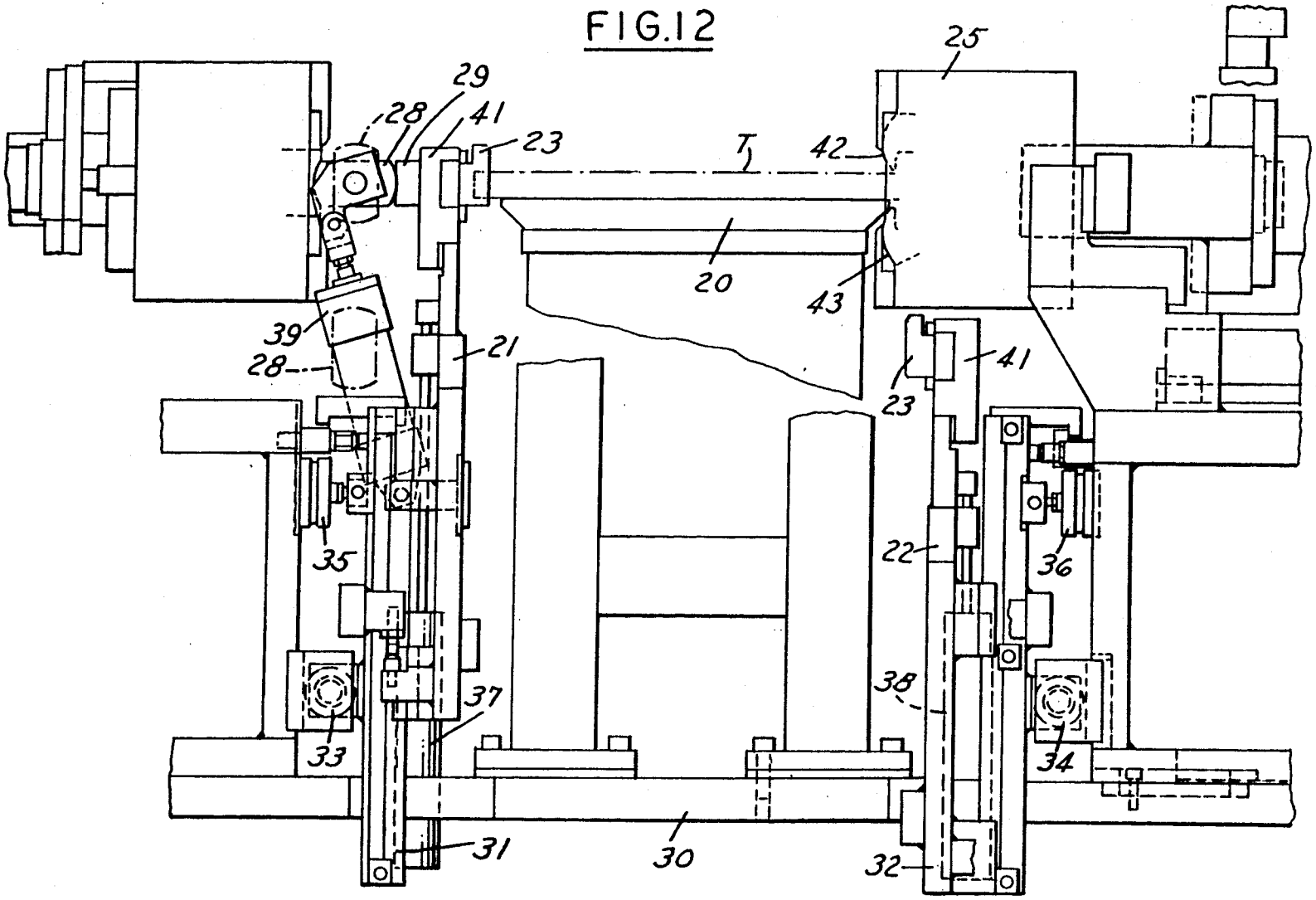
FIG. 12 is a fragmentary front elevational view on an enlarged scale.
Figure 13:
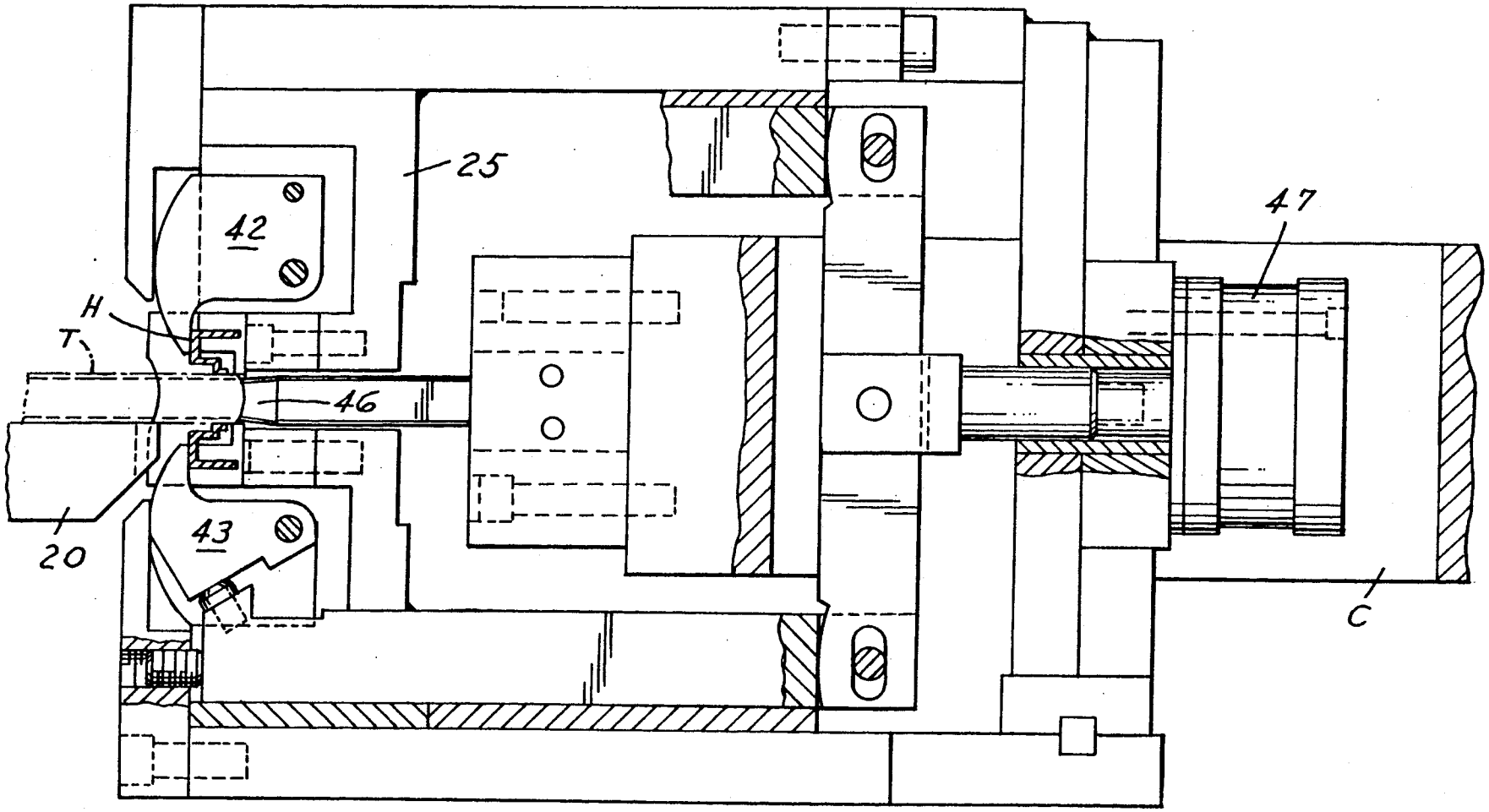
FIG. 13 is a fragmentary part sectional view on an enlarged scale of a portion of the apparatus.
Figure 14:
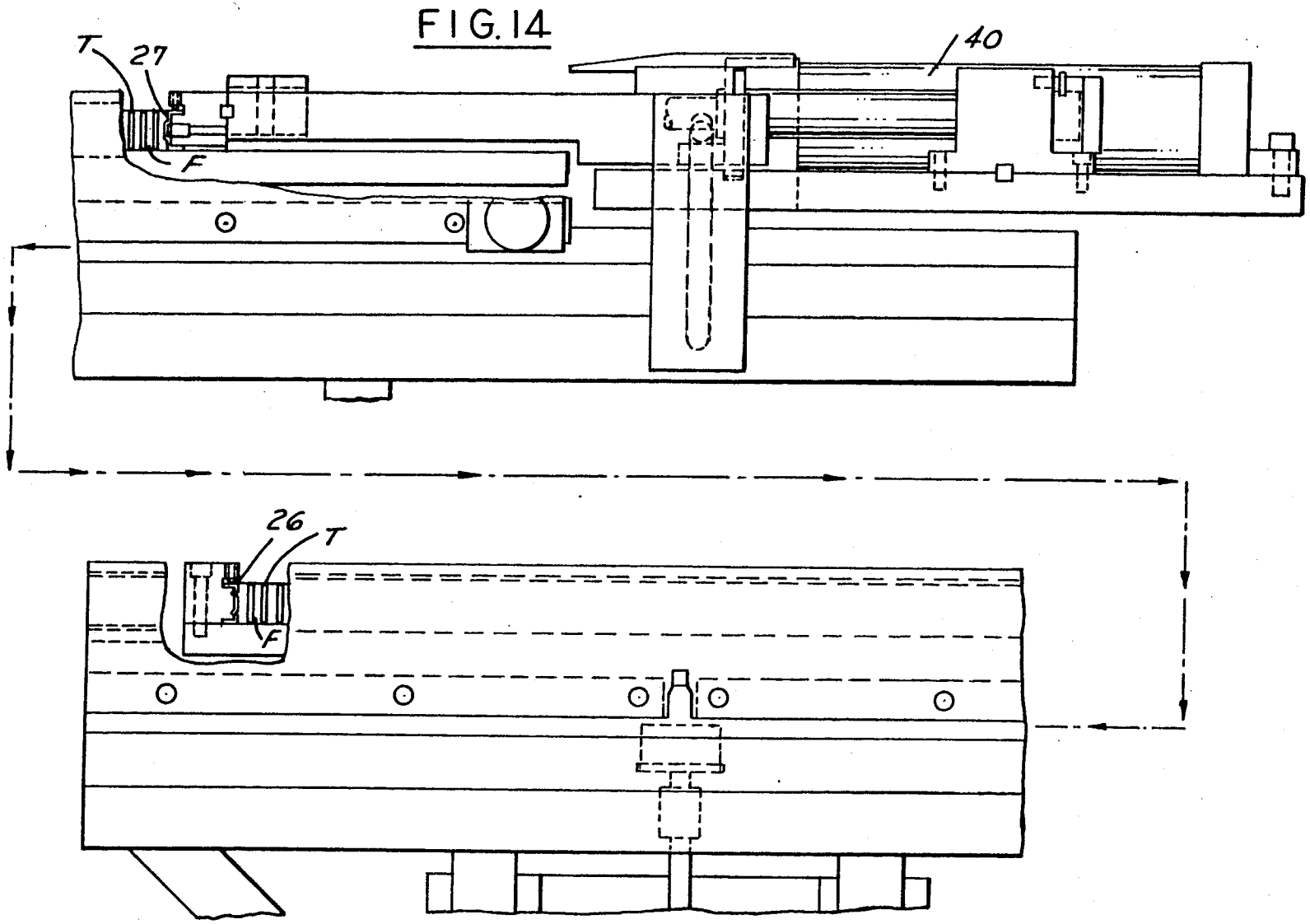
FIG. 14 is fragmentary part sectional side elevational view of a portion of the apparatus.

Referring to FIGS. 8 and 12, the apparatus comprises a frame 30 that supports the table 20 and the other mechanisms. Slides 21, 22 are mounted for vertical movement upon tracks 31, 32 that are pivoted as at 33, 34. Each track 33, 34 is pivoted by its respective cylinder 35, 36. Each slide is reciprocated vertically on its respective track by cylinders 37, 38 respectively. Stop 28 is rotated into and out of position by a cylinder 39 (FIG. 12). Compression plate 27 is reciprocated into and out of compacting position by cylinder 40.

Figure 15:
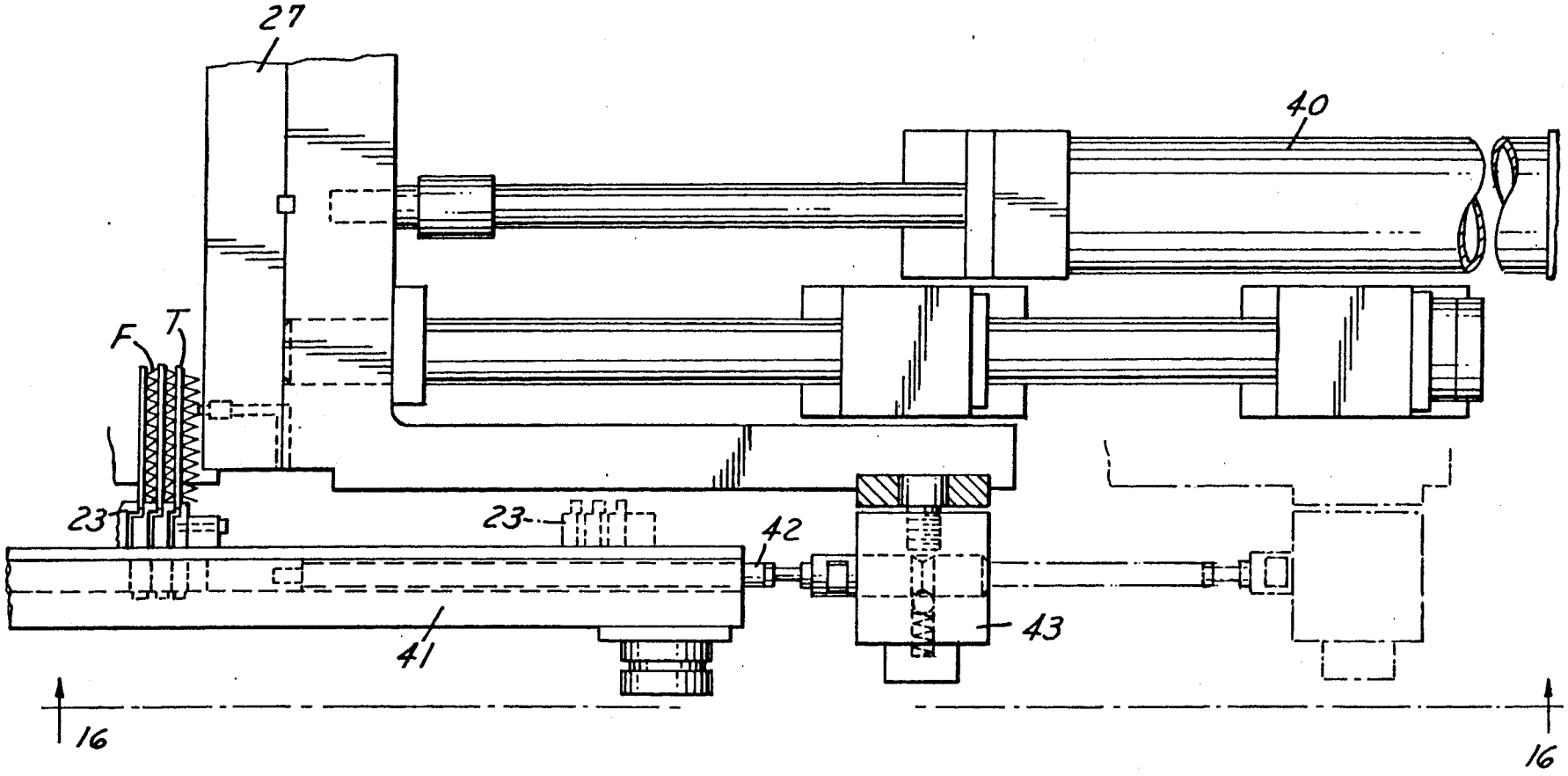
FIG. 15 is a fragmentary plan view of a portion of the apparatus.
Figure 16:
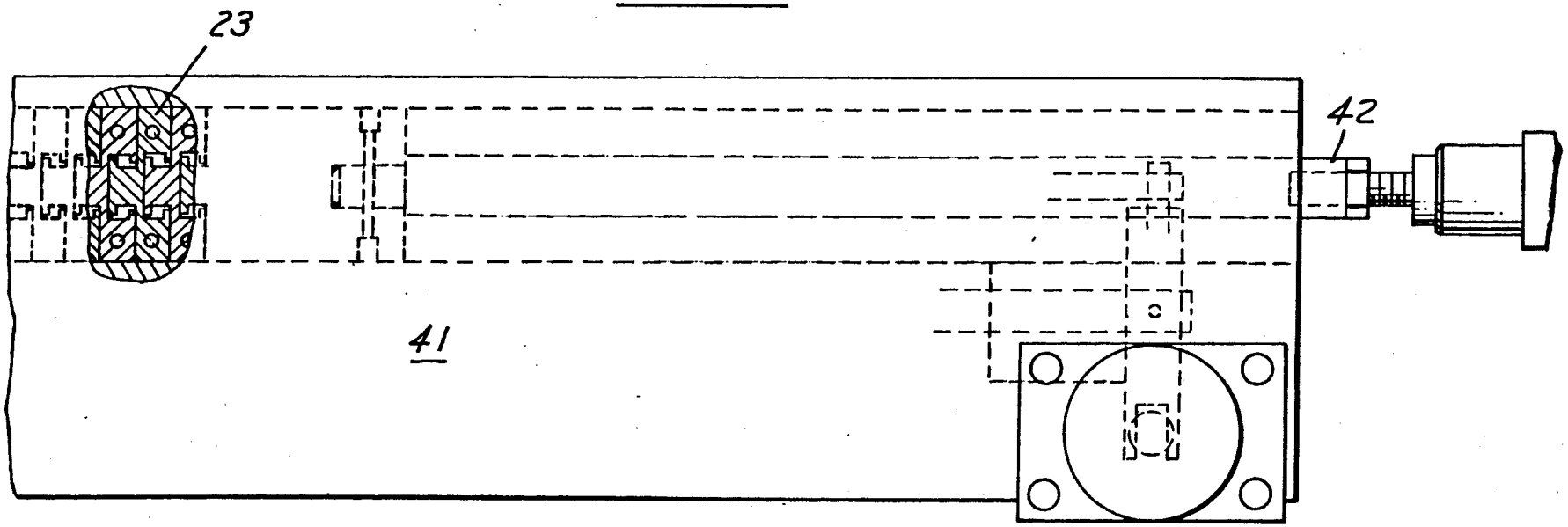
FIG. 16 is a part sectional side view of the portion of the apparatus taken along the line 16—16 in FIG. 15.

A tube dispensing mechanism D (FIG. 9) is reciprocated into position overlying the table and functions in a manner, well known in the art, to successively dispense flattened tubes T between the pickets 23. The pickets 23 are mounted on slide ways 41 on the upper ends of the slides 21, 22 and are interconnected upon expansion as shown in FIGS. 15, 16 and can be expanded (FIG. 2) or compressed (FIG. 4). The end most picket 23 is interconnected to the core clamp 27 by a shaft 42 and mechanical overload connector 43 so that the pickets are expanded and contracted when the cylinder 40 is activated.

Each header support plate 25 is provided with a fixed header retainer 42 (FIG. 13) and a pivoted retainer 43 for holding the header plate H on the header support 25. Cylinders 44 function to move the header support plates 25 inwardly and outwardly to force the ends of the tubes T through the openings in each header plate H. Punches 46 are provided and actuated by a cylinder 47 to deform the ends of the tubes over the outer surface of the headers.

The headers are applied to one end of the tubes in the following sequence:

1. The right hand slide 22 is lowered. Cylinder 45 push the compression plate 27 to position the header plate H on the tubes.

2. Cylinder 47 is activated to activate retainer 43 and force the punches 46 to flare the ends of the tubes.

3. The pressure on the right hand cylinder 45 is relieved.

4. Stop 28 is moved out of position.

5. The left hand slide 21 is lowered.

6. Cylinder 45 is reenergized to function as a stop on the right hand header plate.

7. The left hand cylinder is activated to force the left hand header on the tubes.

8. The left hand cylinder 47 is activated to lock the left hand header and force the left hand punches flare the ends of the tubes.

9. Retract cylinders 50.

It can thus be seen that there has been provided an improved method and apparatus wherein the tubes need not be delivered to that initial array in such precise fashion; where the method and apparatus provides for improved efficiency; and wherein substantial labor saving is achieved.

I claim:

1. The method for forming core assemblies comprising supporting a plurality of flattened tubes in horizontally spaced relationship, each of said tubes having opposed ends, applying forces to the ends of the tubes to align the tubes, interposing undulating fins between adjacent tubes, providing a stop to hold along one end of said tubes any aligned ends of said tubes in alignment, retracting the force on the opposite other ends of the tubes, applying a compacting force to the array of tubes and undulating fins transversely of the tubes, positioning a first header plate adjacent the other end of said tubes, applying a force to said first header plate to force the other ends of the tubes through openings in said header plate, deforming the ends of the tubes against the outer surface of the header plate to move any unaligned tubes into alignment with the remainder of the tubes against the stop, retracting the stop, maintaining the force on the first header plate, positioning a second header plate adjacent the one ends of the said tubes, applying a force on said second header plate to force the one ends of said tubes through openings in said second header plate, applying a force to deform the other ends of the tubes onto said second header plate, and removing the forceson said header plates.

2. The method set forth in claim 1 wherein said step of supporting a plurality of flattened tubes comprises moving pickets adjacent a support and the step of providing a stop comprises moving a stop into and out of engagement with one of said sets of pickets.

3. The method set forth in claim 2 including the steps of successively moving said sets of pickets out of position prior to the step of applying a force to a header plate for forcing the ends of the tubes through openings in the respective header plate.

4. The apparatus for forming core assemblies comprising means for supporting a plurality of flattened tubes in horizontally spaced relationship such that undulating fins may be interposed between adjacent tubes, each of said tubes having opposed ends, means providing a stop along one end of said tubes to hold any aligned ends in alignment, means for applying a force to the opposite other ends of the tubes, means for compacting the array of tubes and undulating fins transversely of the tubes, means for forcing the other ends of the tubes through openings in a first header plate at one end, means for deforming the other ends of the tubes against the outer surface of the first header plate to move any unaligned tubes into alignment with the remainder of the tubes against the stop, means for retracting the stop, means for forcing the one ends of the tubes through openings in a second header plate which maintains force on the first plate, and means for deforming the one ends of the tubes onto the second header plate.

5. The apparatus set forth in claim 4 wherein said means for supporting a plurality of flattened tubes includes a set of expandable and contractable pickets, means for moving said pickets into and out of position with respect to a support.

6. The apparatus set forth in claim 5 wherein said means for providing a stop comprises a stop, means for moving said stop into and out of engagement with one of said sets of pickets.

7. The apparatus set forth in claim 6 wherein said means for moving said sets of pickets into and out of position comprises a slide, and means for supporting said slide for linear movement into and out of position, and means for pivoting said slide laterally into and out of position.

8. The apparatus set forth in claim 7 including means for locking each header plate prior to deforming the ends of the tubes with respect to the header plate.

9. The apparatus set forth in any one of claims 1–8 wherein each of said means includes cylinders for producing the respective movement.

* * * * *